US010158938B1

(12) United States Patent
Jang et al.

(10) Patent No.: US 10,158,938 B1
(45) Date of Patent: Dec. 18, 2018

(54) HORN SPEAKER

(71) Applicants: Electronic Controls Company, Boise, ID (US); Sungju Sound Corp., Suwon-si (KR)

(72) Inventors: Dong Uk Jang, Suwon-si (KR); Brian Olsen, Meridian, ID (US)

(73) Assignees: Electronic Controls Company, Boise, ID (US); Sung Ju Sound Corp., Suwon-si (KR)

( * ) Notice: Subject to any disclaimer, the term of this patent is extended or adjusted under 35 U.S.C. 154(b) by 4 days.

(21) Appl. No.: 15/662,167

(22) Filed: Jul. 27, 2017

(30) Foreign Application Priority Data

May 25, 2017 (KR) ..... 10-2017-0064608

(51) Int. Cl.
*H04R 25/00* (2006.01)
*H04R 1/30* (2006.01)
*H04R 1/02* (2006.01)

(52) U.S. Cl.
CPC ..... *H04R 1/30* (2013.01); *H04R 1/025* (2013.01)

(58) Field of Classification Search
CPC ..... H04R 1/30; H04R 1/025
USPC ..... 381/340, 348, 349, 351, 345
See application file for complete search history.

(56) References Cited

U.S. PATENT DOCUMENTS 4,138,594 A * 2/1979 Klipsch ..... H04R 3/14 181/147
4,215,761 A * 8/1980 Andrews ..... H04R 1/30 181/152
4,313,032 A * 1/1982 Thomas ..... H04R 1/30 181/152
4,524,846 A * 6/1985 Whitby ..... H04R 1/30 181/147
4,790,408 A * 12/1988 Adair ..... H04R 1/26 181/144
4,930,596 A * 6/1990 Saiki ..... H04R 1/2857 181/152
4,953,655 A * 9/1990 Furukawa ..... H04R 1/2819 181/156
4,997,057 A * 3/1991 Furukawa ..... H04R 1/2826 181/156

(Continued)

FOREIGN PATENT DOCUMENTS

GB 2319924 A * 6/1998 ..... H04N 5/642
KR 10-2011-0031570 3/2011

*Primary Examiner* — Phylesha Dabney
(74) *Attorney, Agent, or Firm* — Stoel Rives LLP

(57) ABSTRACT

A horn speaker improves ambience and sound quality by minimizing the transmission of sound diffusion and noise while maximizing the transmission of source sound generated by a speaker unit. The sound emitted by the speaker unit is collected in a seating groove and discharged through a discharge outlet of the horn speaker by integrally forming a plurality of horns in primary and secondary cases of the horn speaker enclosure. A simplified structure reduces the size of the horn speaker and difficulty associated with its assembly. The reproduction band of sound can be extended by forming a horn in a duct structure and adding sound pressure by combining it with sound emitted from the resonance of the duct in forward and backward directions. The amplitude of the resonance point is reduced in the same band and consequently advantageously reduces distortion of the sound.

11 Claims, 13 Drawing Sheets

(56) References Cited

U.S. PATENT DOCUMENTS

| | | | | | |
|---|---|---|---|---|---|
| 5,004,066 | A * | 4/1991 | Furukawa | H04R 1/2819 | 181/156 |
| 5,012,889 | A * | 5/1991 | Rodgers | H04R 1/2819 | 181/144 |
| 5,099,948 | A * | 3/1992 | Melhart | H04R 1/30 | 181/152 |
| 5,173,575 | A * | 12/1992 | Furukawa | H04R 1/2826 | 181/148 |
| 5,307,418 | A * | 4/1994 | Sumitani | H04S 3/00 | 181/145 |
| 5,335,283 | A * | 8/1994 | Torii | G10H 1/0091 | 181/145 |
| 5,373,564 | A * | 12/1994 | Spear | H04R 1/2857 | 181/156 |
| 5,604,337 | A * | 2/1997 | Sugimoto | H04N 5/642 | 181/152 |
| 5,821,471 | A * | 10/1998 | McCuller | H04M 1/035 | 181/156 |
| 6,012,542 | A * | 1/2000 | Accordino | H04R 1/2811 | 181/152 |
| 6,560,343 | B1 * | 5/2003 | Kim | H04R 5/02 | 181/156 |
| 6,561,311 | B2 * | 5/2003 | Chuang | H04R 1/02 | 181/148 |
| 7,743,878 | B1 * | 6/2010 | Moore | H04R 1/2865 | 181/145 |
| 8,194,905 | B1 * | 6/2012 | Vinther, Sr. | H04R 1/26 | 381/181 |
| 8,351,631 | B2 | 1/2013 | Lee et al. | | |
| 2015/0382090 | A1 * | 12/2015 | Bisset | H04R 1/2819 | 381/386 |

* cited by examiner

HORN SPEAKER

TECHNICAL FIELD

The present disclosure pertains to a horn speaker, and more specifically, pertains to an enclosure of a speaker having multiple integrally formed horn parts.

BACKGROUND INFORMATION

In general, horn speakers are known as speakers that emit sound from a diaphragm into an external space through a horn. Although horn speakers are more efficient than directly emitting speakers and can control the directionality of the sound through the horn shape, the reproduction range of sound is relatively narrow, and they are mainly used as speakers for mid- to high-range sound. In addition, the speaker causes the diaphragm to vibrate with an electrical frequency, and the sound from vibration of the diaphragm is transmitted through the air. The wavelength of the sound hit by the air spreads in the desired direction through the speaker's horn or affects the sound volume. This horn speaker is constituted by an electroacoustic conversion unit. It is a piezoelectric horn speaker if the diaphragm of the electroacoustic conversion unit is vibrated by a piezoelectric element; and it is a dynamic horn speaker if the diaphragm is vibrated by a voice coil, which is vibrated by electromagnetic force.

Such speaker devices have a structure for reproducing the voice by converting, into vibration of the vibration member, the voice signal current reproduced by sound signal generators such as audio equipment, public address (PA) equipment for broadcasting, and sirens. For such speaker devices, development of a structure for faithful restoration of the original sound is actively being carried out.

The traditional speaker device described above is shown in prior art Korean Patent Application No. 10-2009-0088885. In considering such traditional speaker, as shown in FIGS. 1 and 2, a radial horn speaker (1) is comprised of a cabinet (10), a duct (20), a speaker unit (30) and a horn part (40). In such configuration, the rear panel (13) of the cabinet is generally coupled to one side of the cabinet body (11) in such a way that the sound emitted from the baffle furnished in the speaker unit (30) is delivered to the front of the cabinet body (11), and a coupling step (13*a*) is formed at a predetermined height on one side of the cabinet rear plate (13) to fasten the cabinet rear plate (13) to the inside (12) of the cabinet body (11). The duct (20) is coupled to a surface (23) of the opposite side of the cabinet body (11). The body of the speaker unit (30) is passed through a central opening (22) in the duct (20) and is positioned within the inside (12) of the cabinet body (11). The rim of the diaphragm housing of speaker unit (30) is set on the annular base of the horn (40), which is coupled to an exterior end face of the duct (20). As such, the cabinet (10) is coupled to the cabinet rear plate (13) through a plurality of retaining pins to prevent it from breaking away when the duct (20) is fastened. Accordingly, the cabinet rear plate (13) plays a role of helping the output of the sound produced from the speaker unit (30) according to the sound occurred due to the baffle (not shown) being emitted between the horn (40) and the duct (20) that is coupled to the speaker unit (30).

However, according to the prior art structural feature, it has a structure of the horn (40) and the duct (20) being coupled in one direction. Here, the efficiency of the speaker is improved as the length of the horn (40) becomes longer, given that its conformity to the air is improved accordingly.

However, since the horn (40) is installed in a separate duct (20) for the conventional structure, it limits the size and length of the horn (40) and reduces the efficiency of the speaker unit (30). Also, it is difficult to perform multiple sound reproduction, by classifying the sound of multiple bands with one speaker unit (30). In addition, since the source sound of the speaker unit (30) is emitted only through the discharge outlet of the horn installed in the front direction, there is an issue wherein diffusion of the source sound is not smoothly transmitted towards the rear.

SUMMARY OF THE DISCLOSURE

The disclosed horn speaker has been developed in order to resolve the problems mentioned above. The horn speaker configured according to the present disclosure includes a plurality of horns that are integrally formed in a primary case and a secondary case of a horn speaker enclosure. The horn speaker enclosure contains a plurality of speaker units. Furthermore, since a plurality of discharge outlets of the horn speaker are formed in the front direction of the primary case and the rear direction of the secondary case, the transmission effect of emission of the sound produced by the sound source and occurring due to the speaker units to the outside through the horn speaker can be maximized, while the ambience and the sound quality are improved, by minimizing transmission of the sound diffusion and noise.

In addition, the sound separation and the clarity are improved by integrating the horn speaker in a single body.

Also, the size of the horn speaker enclosure is decreased by simplifying the structure, which thereby provides a production cost reduction as well as a reduction in the inconvenience of the component assembly.

For achieving the above purpose, the horn speaker according to the present disclosure includes an enclosure comprised of a primary case and a secondary case for housing a speaker unit that converts electrical signals to sound signals and generates sound waves, and a plurality of horn parts that are formed inside of the enclosure; and the plurality of horn parts comprise a primary half of the horn and a secondary half of the horn.

In addition, the primary half of the horn is comprised of a partition, a discharge outlet and a seating groove. The partition guides the source sound discharged from a speaker unit to an ejection port, the discharge outlet expands the source sound discharged from the speaker unit and discharges it, and the seating groove collects the source sound discharged from the speaker unit.

Also, the secondary half of the horn is equipped with a seating part. The seating part extends from one side of the secondary half of the horn to the other side of the primary half of the horn.

Preferably, the primary case has a plurality of the primary half of the horn.

Preferably, the secondary case is furnished with a plurality of the secondary half of the horn.

Preferably, the primary case has a primary half and a secondary half of the horn.

Preferably, the secondary case has a primary half and a secondary half of the horn.

Preferably, the number of speaker units installed is the same as or fewer than the number of the horn parts.

Preferably, a plurality of horn parts are formed into a duct-shaped structure when the primary case and the secondary case are coupled.

The horn speaker according to the present disclosure with the characteristics described above improves the ambience and the sound quality by minimizing the transmission of sound diffusion and noise, while maximizing the sound transmission effect when the source sound generated by the speaker unit and collected in the seating groove is discharged through the discharge outlet of the horn by integrally forming a plurality of horns in the primary case and secondary case of the enclosure.

Also, the size of the product and difficulty associated with parts assembly, as well as the cost of production, are reduced by simplifying the structure.

In addition, the reproduction band of sound can be extended by forming a horn in a duct structure and adding sound pressure by combining it with the sound emitted from the resonance of the duct in a forward and backward direction. Since the amplitude of the resonance point is reduced in the same band, there is an advantage in that distortion of the sound is reduced.

DETAILED DESCRIPTION OF PREFERRED EMBODIMENTS

Advantages and features of the disclosed horn speaker and ways to accomplish them should be made clear by referring to embodiments that are later described in detail alongside with attached drawings. However, the present invention is not limited to the embodiments described below, but is embodied in a variety of mutually different forms.

The present embodiments described in this specification are provided to enable construction of the disclosed horn speaker and to fully disclose the scope of the invention to skilled persons. Also, the present invention is merely defined by the scope of the claims. Therefore, in some embodiments, well-known components, well-known actions and well-known techniques are not specifically described so as to prevent the present invention from being interpreted in an ambiguous manner.

Throughout the specification, the same reference numbers refer to the same structural components. Also, terms used (mentioned) in this specification are merely for explaining the embodiments, and shall not limit the present invention. In this specification, the singular forms include plural forms unless they are specifically mentioned in the phrase. In addition, components and actions mentioned with 'includes (or, furnishes)' do not exclude the existence or addition of one or more of other components and actions.

If there are no separate definitions, all terms used in this specification (including technical and scientific terms) can be used in a sense commonly understood by skilled persons. Also, terms defined in commonly used dictionaries should not be ideally or excessively interpreted unless they are defined.

Figure 1:
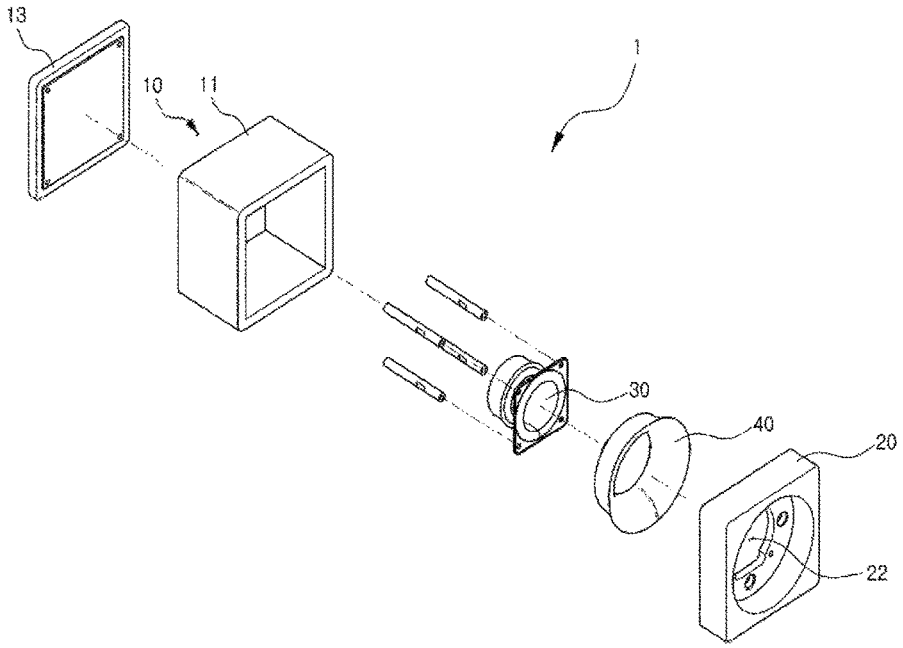
FIG. 1 (PRIOR ART)
FIG. 1 is an exploded perspective view showing the configuration of a conventional speaker.
Figure 2:
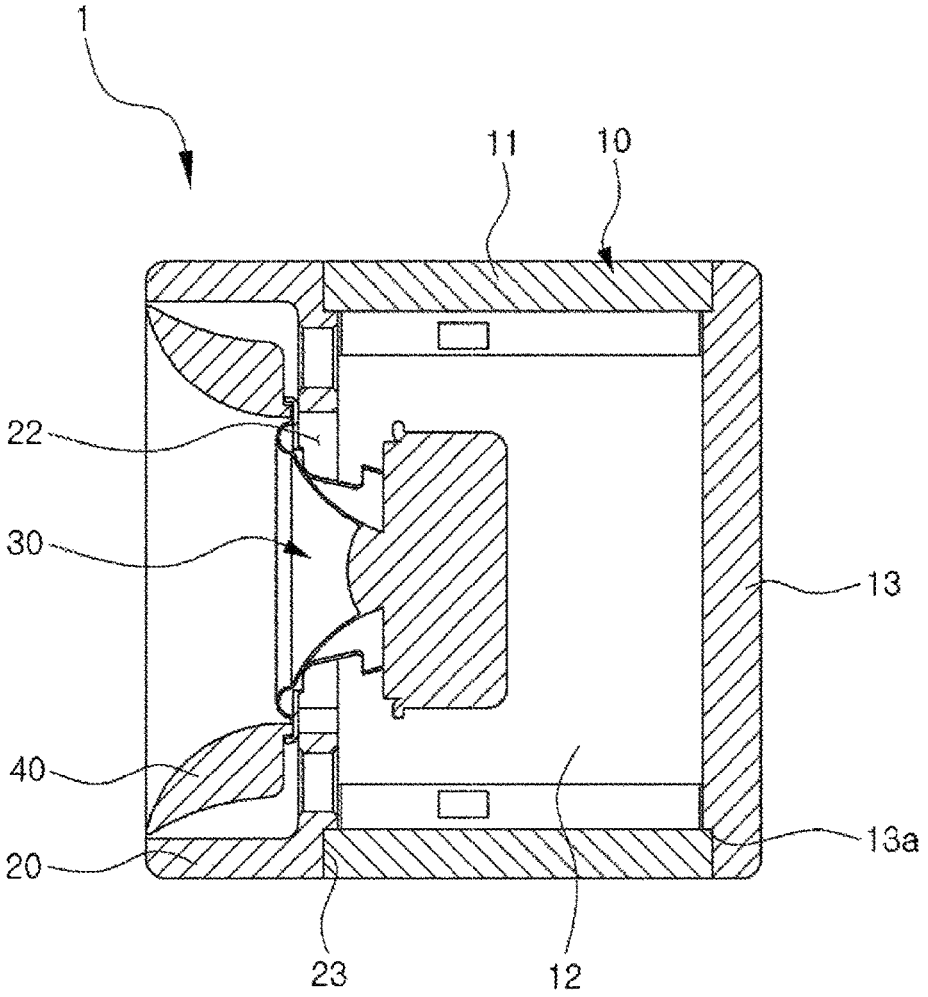
FIG. 2 (PRIOR ART)
FIG. 2 is an enlarged cross-sectional view showing a configuration of the conventional speaker of FIG. 1.
Figure 3:
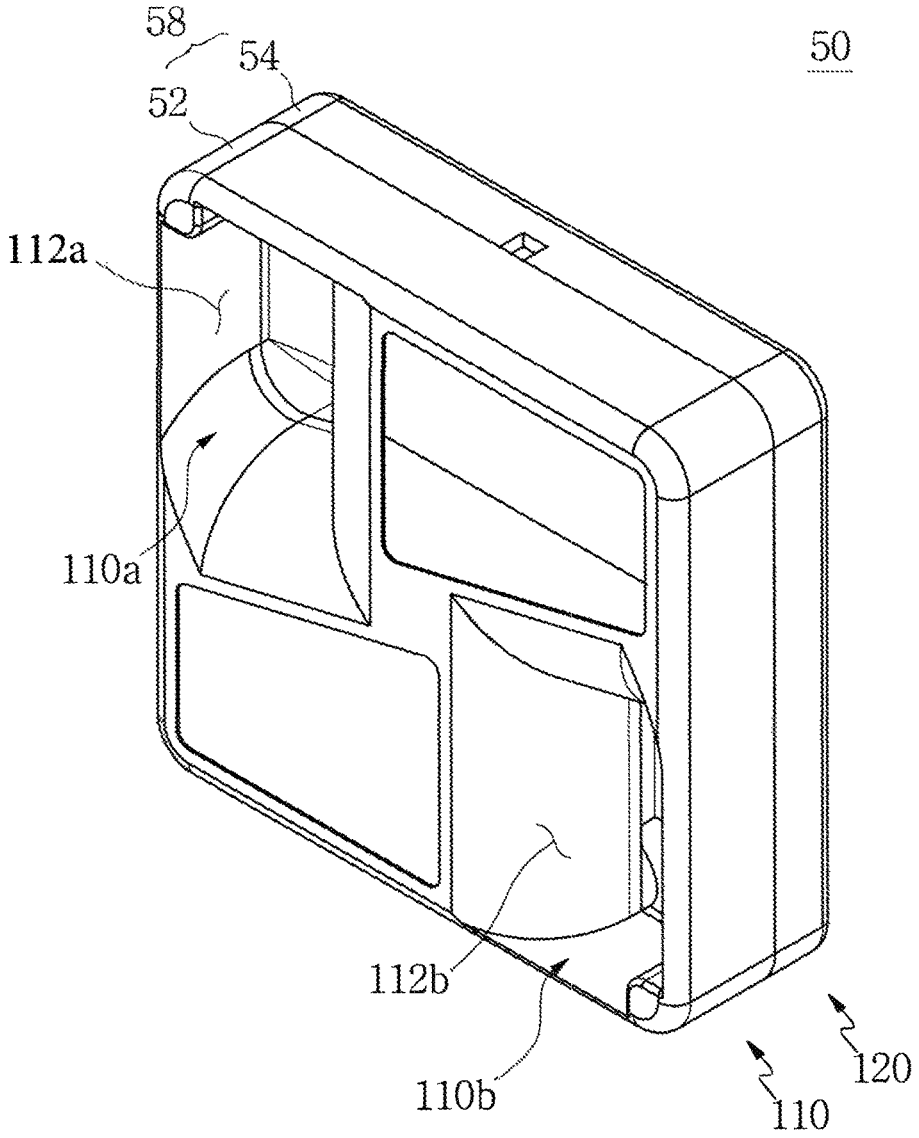
FIG. 3 is a perspective view schematically showing the configuration of the horn speaker according to the present disclosure.
Figure 4:
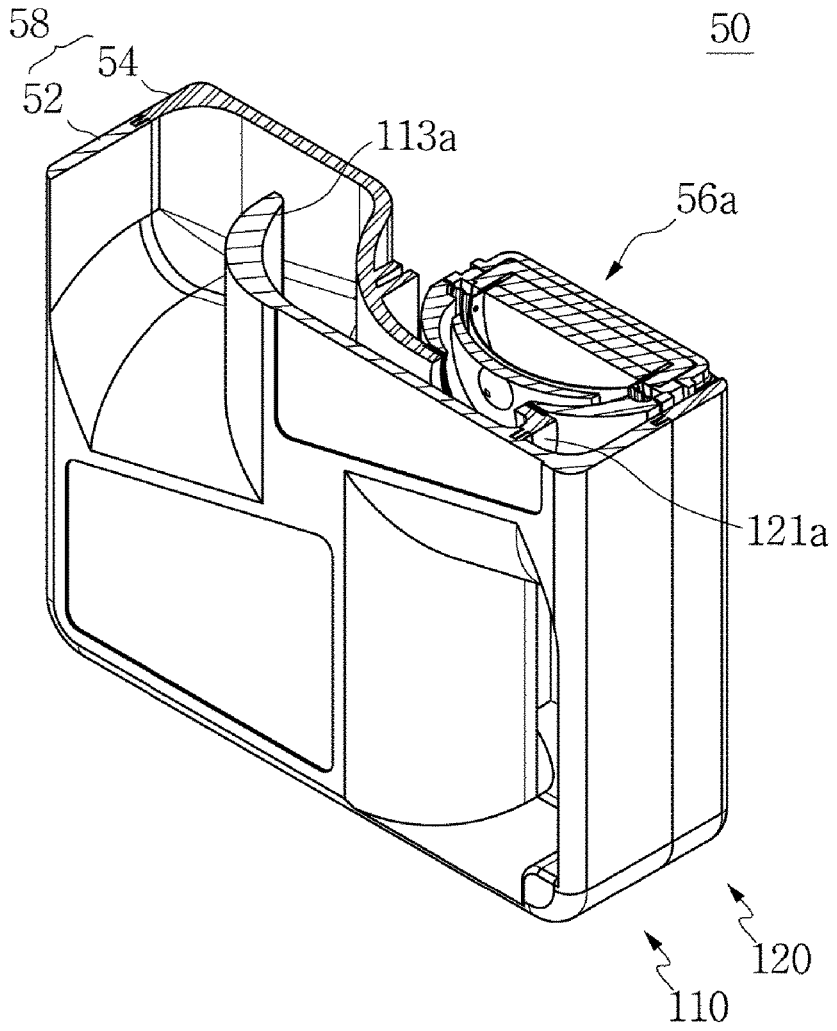
FIG. 4 is a partially cut away perspective view showing a part of FIG. 3.
Figure 5:
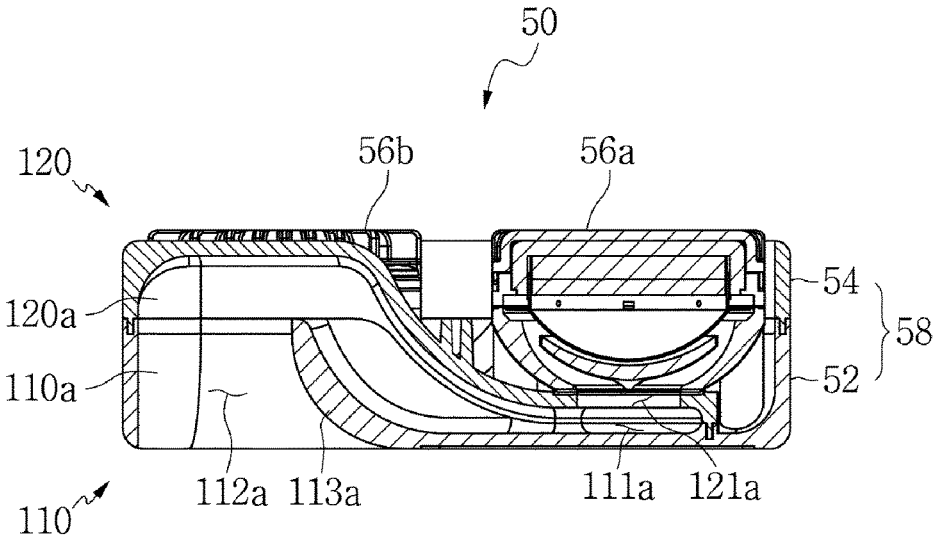
FIG. 5 is a cross-sectional view showing a cross-section portion of FIG. 4.
Figure 6:
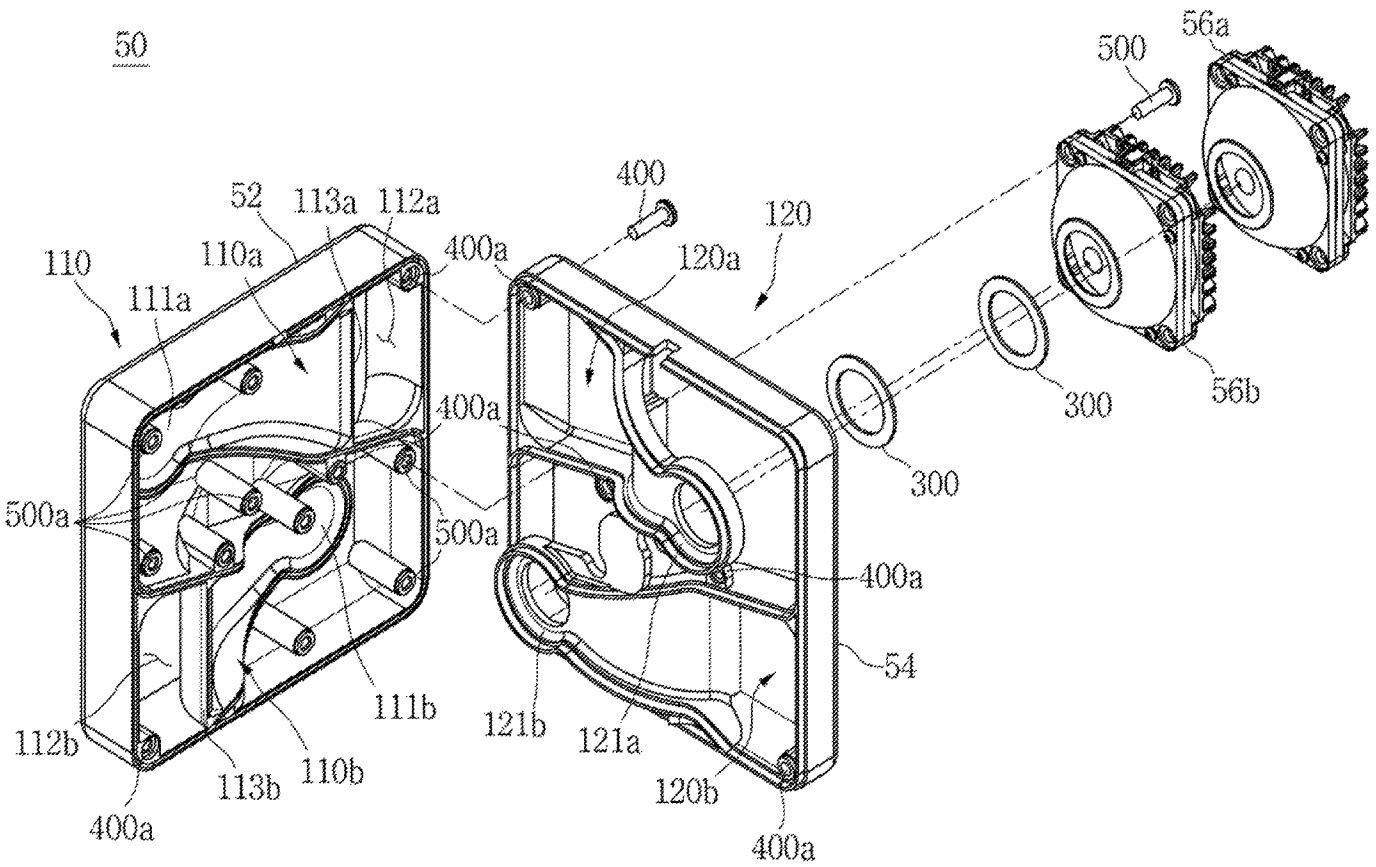
FIG. 6 is an exploded perspective view of the horn speaker according to the present disclosure.
Figure 7:
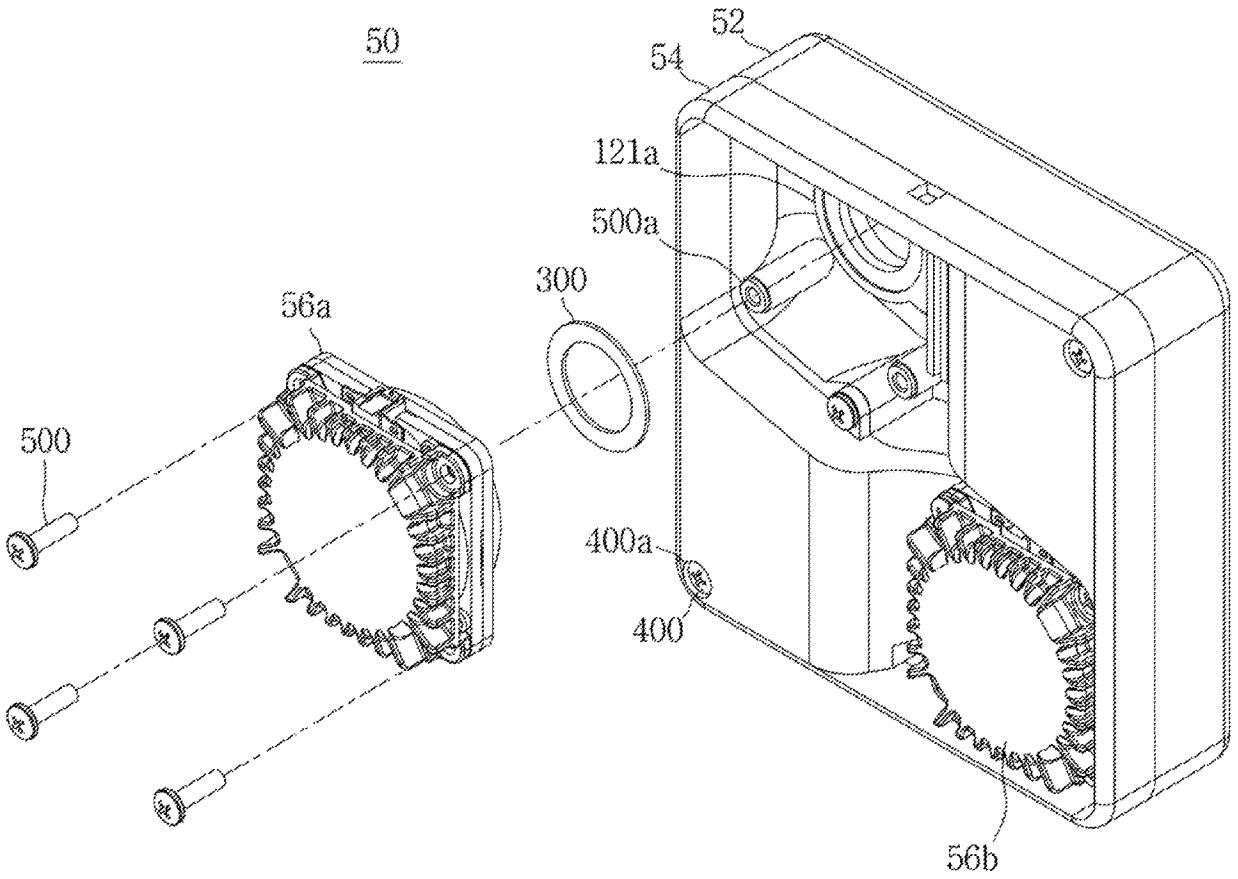
FIG. 7 is a partially exploded perspective view showing from the rear side the horn speaker according to the present disclosure.
Figure 8:
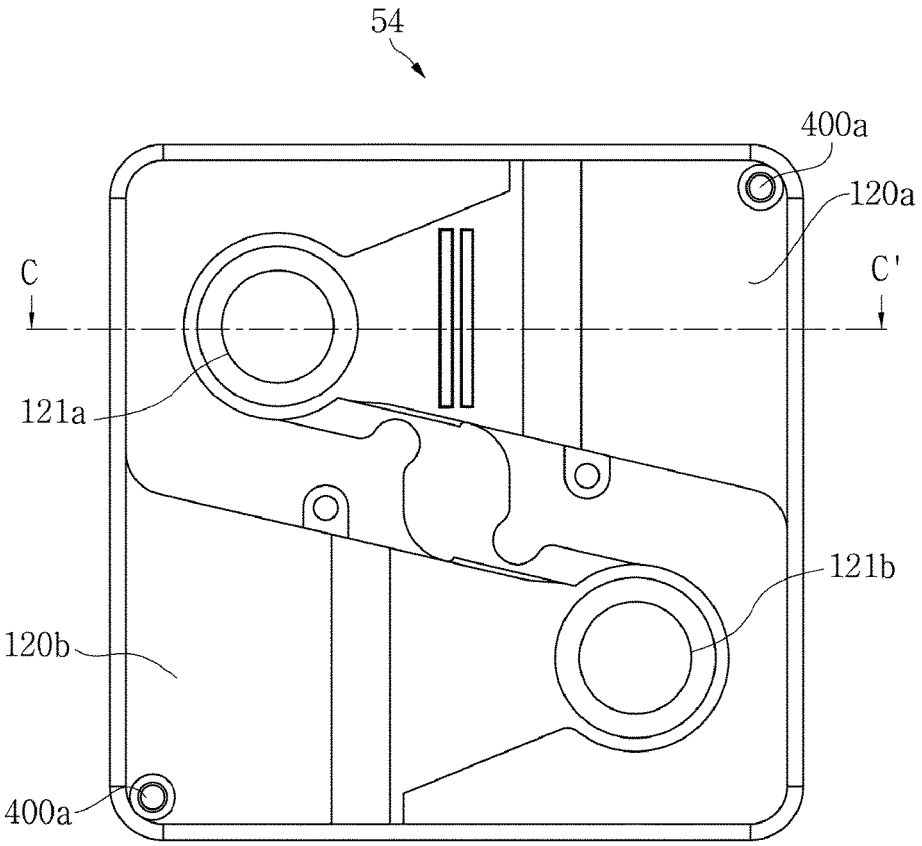
FIG. 8 is a view showing the rear side of the secondary case of the horn speaker according to the present disclosure.
Figure 9:
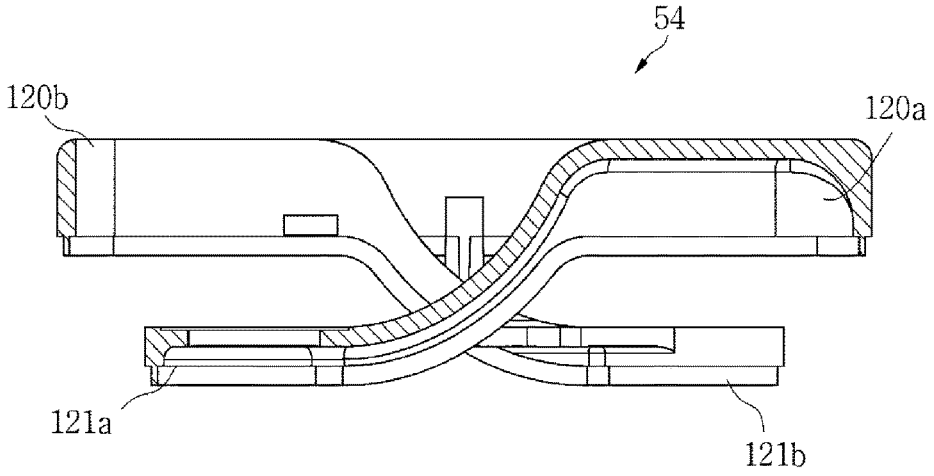
FIG. 9 is a cross-sectional view of the line C-C' portion of FIG. 8 cut away.
Figure 10A:
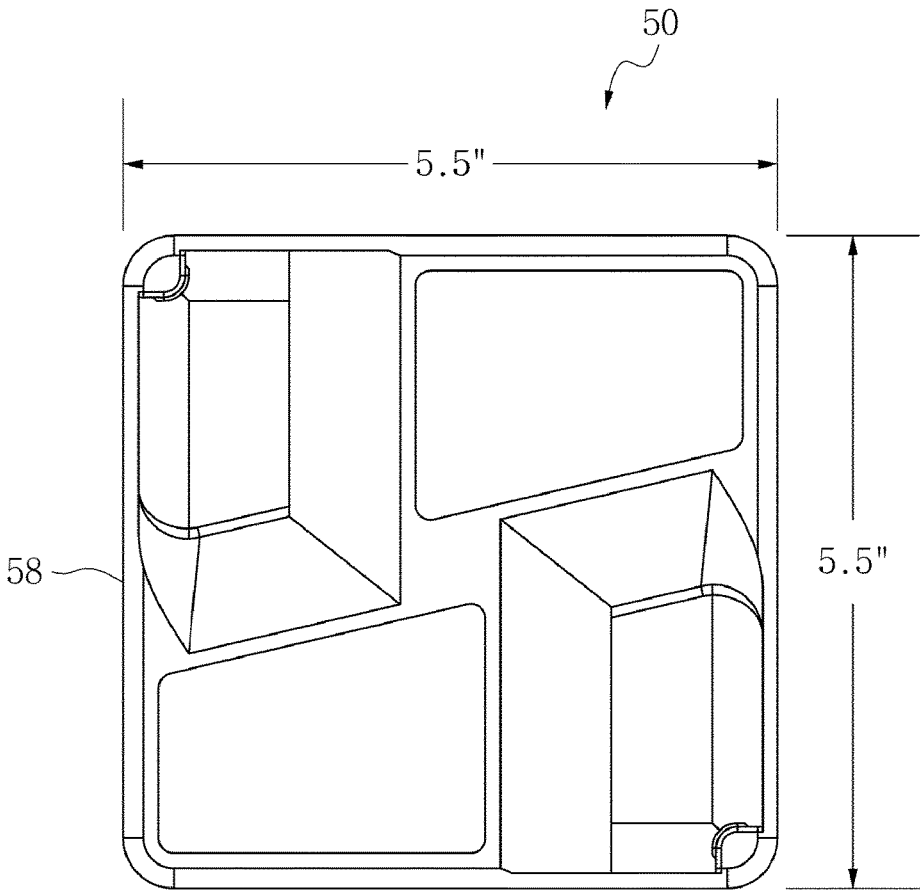
FIG. 10A is a frontal view showing the length and width dimensions of the horn speaker according to the present disclosure.
Figure 10B:
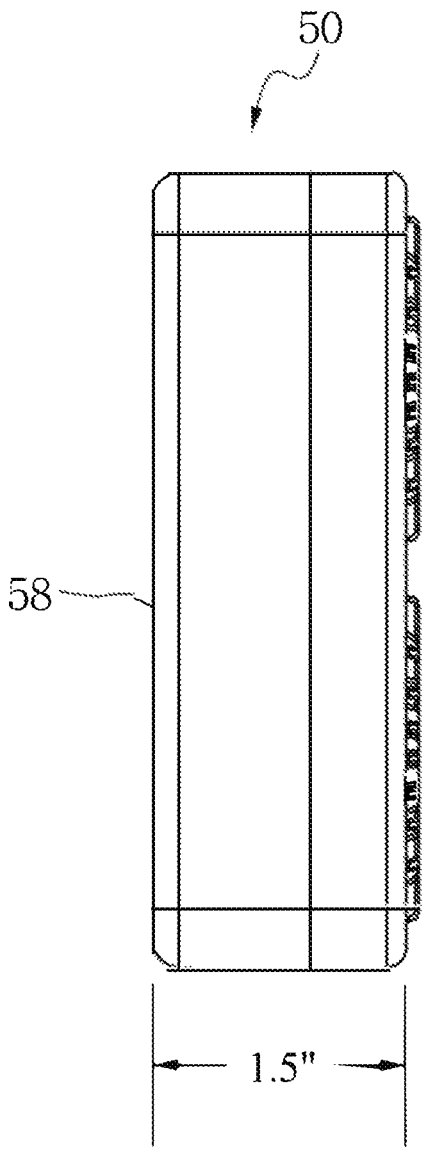
FIG. 10B is a side view showing the thickness dimension of the horn speaker according to the present disclosure.
Figure 11:
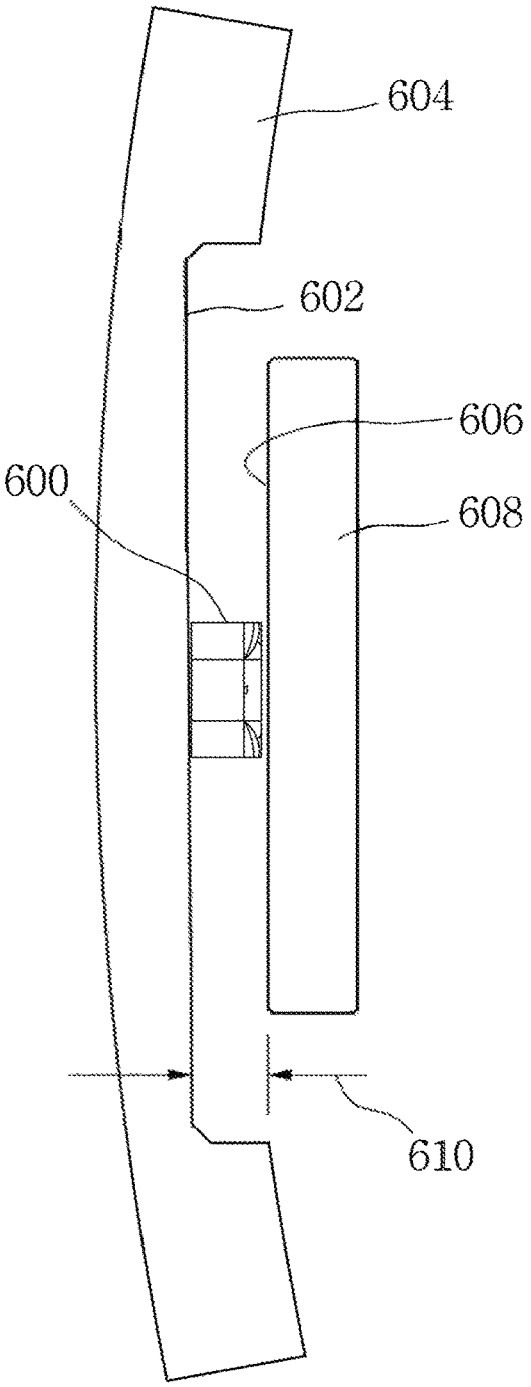
FIG. 11 (PRIOR ART)
FIG. 11 shows a state in which a conventional horn speaker is installed in a space between a front grille and a radiator assembly installed in an engine compartment of an existing vehicle.
Figure 12:
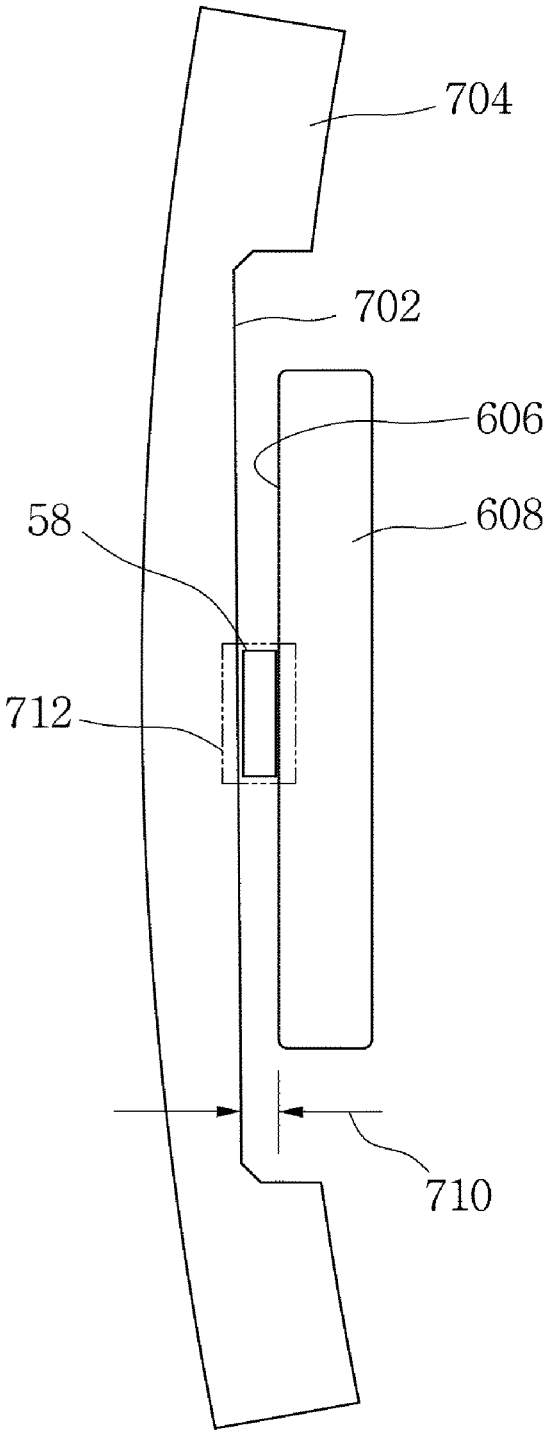
FIG. 12 shows a state in which the horn speaker according to the present disclosure is installed in a space between a front grille and a radiator assembly installed in an engine compartment of a newly designed vehicle.

Hereinafter, the technical features of the disclosed embodiments will be described in detail with reference to the accompanying drawings. FIG. 3 is a perspective view schematically showing the configuration of the horn speaker according to the present disclosure. FIG. 4 is a partially cut away perspective view showing a part of FIG. 3. FIG. 5 is a cross sectional view showing a cross-section portion of FIG. 4. FIG. 6 is an exploded perspective view of the horn speaker according to the present disclosure. FIG. 7 is a partially exploded perspective view showing the horn speaker from the rear side according to the present disclosure. FIG. 8 is a view showing the rear side of the secondary case of the horn speaker according to the present disclosure. FIG. 9 is a cross-sectional view of the line C-C' portion of FIG. 8 cut away. FIG. 10A is a frontal view showing the length and width dimensions of the horn speaker according to the present disclosure. FIG. 10B is a side view showing the thickness dimension of the horn speaker according to the present disclosure. FIG. 11 shows a state in which a conventional horn speaker is installed in a space between a front grille and a radiator assembly installed in an engine compartment of an existing vehicle. FIG. 12 shows a state where the horn speaker according to the present disclosure is installed in a space between a front grille and a radiator assembly installed in an engine compartment of a newly designed vehicle.

FIG. 3 through FIG. 9 show a horn speaker (50), in which there are a plurality of primary half sections (110*a*, 110*b*; also referred to as "primary inner sections") of a horn part (110) in the interior of a primary case (52), and a plurality of secondary half sections (120*a*, 120*b*; also referred to as "secondary inner sections") of a horn part (120) in the interior of a secondary case (54). Primary and secondary half sections (110*a*, 120*a*) and (110*b*, 120*b*) form separate, similar horn subassemblies of the horn speaker (50). The horn components and features of the horn subassembly formed by primary and secondary half sections (110*a*, 120*a*) have reference numbers with the suffix "a", and the horn components and features of the horn subassembly formed by primary and secondary half sections (110*b*, 120*b*) have reference numbers with the suffix "b". The following description is directed to the horn subassembly formed by the primary and secondary half sections (110*a*, 120*a*) but similarly applies to the horn subassembly formed by primary and secondary sections (110*b*, 120*b*).

As shown in the drawings, a horn speaker (50) according to the present disclosure includes a speaker unit (56*a*) that generates a sound wave by converting an electric signal into a sound wave signal; an enclosure (58) comprised of primary case (52) and secondary case (54) for furnishing the speaker unit (56*a*); and a plurality of horn parts (110, 120) formed inside of the enclosure (58). The plurality of horn parts (110, 120) include a primary half section (110*a*) of the horn part (110) and a secondary half section (120*a*) of the horn part (120). Primary half section (110*a*) of the horn part (110) includes a seating groove (111*a*) that collects the source sound discharged from the speaker unit (56*a*), a discharge outlet (112*a*) that expands the source sound collected on the seating groove (111*a*) and discharges the source sound towards the outside of the enclosure (58), and a partition wall (113*a*) that guides the source sound collected in the seating groove (111*a*) to the discharge outlet (112*a*). Secondary half section (120*a*) of the horn part (120) extends from one side of secondary half section (120*a*) of the horn part (120) to the other side of primary half section (110*a*) of the horn part (110) and includes a seating location (121*a*) where the speaker unit (56*a*) is seated.

In reference to FIGS. 3 through 9, according to an embodiment of the present disclosure, primary case (52) of a rectangular shape has a plurality of integrally formed primary half sections (110*a*, 110*b*) of the horn part (110) for collecting and amplifying sound sources discharged from the speaker units (56*a*, 56*b*). The primary half section (110*a*) of the horn part (110) is formed at one end, and the primary half section (110*b*) of the horn part (110) is formed at other end of the inner surface of the primary case (52). Such primary half sections (110*a*, 110*b*) of the horn part (110) are integrally formed together with seating grooves (111*a*, 111*b*), respectively, which form a structure for collecting source sounds generated from the speaker units (56*a*, 56*b*). It is preferable that seating grooves (111*a*, 111*b*) be formed to correspond to the shape and size of the speaker units (56*a*, 56*b*).

Further, in reference to FIGS. 5 and 6, primary half section (110*a*) of the horn part (110) formed in primary case (52) extends beyond the partition wall (113*a*) on the opposite side of the seating groove (111*a*) and to the outer surface of the discharge outlet (112*a*) and is formed as its area is radially and gradually enlarged. Herein, the partition wall (113*a*) has a structure for performing a function of a guttural sound reinforcement to prevent the source sound collected in the seating groove (111*a*) from being dispersed and can be formed at an even higher height than that of the seating groove (111*a*). Also, when the discharge outlets (112*a*, 112*b*) of a plurality of primary sections (110*a*, 110*b*) of the horn part (110) are formed on one side of the enclosure (58), discharge outlets (112*a*, 112*b*) of the respective primary half sections (110*a*, 110*b*) of the horn part (110) are formed in different places on the one side of the enclosure (58). Hereby, the separation and clarity of sound is improved by increasing the diffusion of the collected sound by causing the directions of emission to be different from one another when the source sounds generated by the speaker units (56*a*, 56*b*) are discharged to the outside through primary halves (110*a*, 110*b*) of the horn part (110).

Further, in reference to FIGS. 5 through 7, secondary case (54) of the rectangular shape has a plurality of secondary sections (120*a*, 120*b*) of the horn part (120) that are integrally formed for collecting and amplifying the source sound discharged from the speaker units (56*a*, 56*b*). Secondary half section (120*a*) of the horn part (120) is formed at one end, and second half section (120*b*) of the horn part (120) is formed at the other end of the inner surface of secondary case (54). Such secondary half section (120*a*) of the horn part (120) has a seating location (121*a*). Secondary half section (120*a*) of the horn part (120) is extended from one side of secondary case (54) to the other side of primary case (52) and towards the seating groove (111*a*) formed in the primary half section (110*a*) of the horn part (110) and is formed in a hook shape. Also, the seating location (121*a*) is integrally formed at the end of the hook-shaped secondary half section (120*a*) of the horn part (120). It is preferable that the seating location (121*a*) is formed to correspond to the shape and size of the aforementioned seating groove (111*a*) and the speaker unit (56*a*). In addition, the hook-shaped secondary half section (120*a*) of the horn part (120) is coupled with a curved surface in conformity with the shape of the primary half section (110*a*) of the horn part (110) formed in primary case (52) described above.

Therefore, when coupling together primary case (52) and secondary case (54), a duct structure having a curved surface shape is formed for primary and secondary half sections (110*a*, 120*a*) of the horn parts (110, 120) and, more specifically, it is in a hollow form and serves to guide the source sound discharged from the speaker units (56*a*, 56*b*) to the outside. Furthermore, the seating location (121*a*) is provided with a space in which the speaker unit (56*a*) can be seated and installed. In addition, when discharge outlets (112*a*, 112*b*) of a plurality of secondary sections (120*a*, 120*b*) of the horn part (120) are formed on one side of the enclosure (58), secondary half sections (120*a*, 120*b*) of the horn part (120) are formed in a same way described above on the other side in a manner that is consistent with the placement of the discharge outlets (112*a*, 112*b*). Additionally, the seating location (121*a*) formed in secondary case (54) has a flexibility quality and improves the loudness by preventing the source sound generated from the speaker unit (56*a*) from being leaked because it is attached with high adhesion and due to its flexible quality when primary case (52) and secondary case (54) are coupled to each other.

The speaker unit (56*a*) configured according to the present disclosure can include components such as a permanent magnet, coil, and diaphragm. In such a speaker unit (56*a*), a magnetic field is generated when current flows in the coil, and the coil is vibrated by a magnetic field produced from the current flow-generated magnetic field and the permanent magnet. This causes the diaphragm connected to the coil to move, vibrate the air and emit sound. Furthermore, the speaker unit (56*a*) is formed in a semicircular shape, but can be designed, without limitations, in various shapes such as elliptical, rectangular and circular. Also, the material of permanent magnet is an alloy including aluminum, nickel and cobalt; and since this is typical, a detailed description is omitted.

In addition, the rectangular primary case (52) and secondary case (54) of the enclosure (58) mentioned above can be formed in not only a rectangular shape, but also in various forms. These various forms include a circle, a rectangle, a square, and a streamline and are not limited to forms described in this specification.

The coupling method of the enclosure (58) mentioned above entails use of case fasteners (400*a*) that are formed around the edges of the inner surfaces at diagonally opposite corners of primary case (52) and secondary case (54). As shown in FIGS. 6 and 7, four holes arranged diagonally spaced apart from each other receive case fastening members (400) to secure together primary case (52) and secondary case (54) when they are coupled. At such time, primary and secondary sections (110*a*, 120*a*) of the primary and secondary horn parts (110, 120), which are integrally formed, have a duct structure that covers the entire rear portion of the speaker unit (56*a*). This allows the reproduction band of sound to be extended by favorably collecting, in a forward direction, the guttural sound discharged to the rear of the interiors of primary and secondary sections (110*a*, 120*a*) of the horn parts (110, 120). Since the amplitude of the resonance point in the same band is decreased, the distortion of the sound is reduced. Then, the speaker unit (56*a*) is installed at the upper part of the seating location (121*a*) formed in the space of secondary case (54), and the unit fastener (500*a*) is formed around the seating groove (111*a*) of primary case (52) and seating location (121*a*) of secondary case (54). As shown in FIGS. 6 and 7, the unit fastener (500*a*) is preferably formed by four holes, each corresponding to the rectangular case of the speaker units (56*a*) and (56*b*). Herein, to prevent the source sound generated from speaker unit (56*a*) from being leaked from the upper part of the seating location (121*a*), a separate sealing member (300) is initially seated at the upper part of the seating location (121*a*) when the speaker unit (56*a*) is coupled. Here, the sealing member (300) is, for instance, used for maintaining the airtightness, similar to a gasket, and is a conventional component part; therefore, a detailed description is omitted. Then, the speaker unit (56*a*) is mounted on the upper part of the sealing member (300) and is coupled by the unit fastening member (500). Herein, the speaker unit (56*a*) may be installed according to the number of discharge outlets of primary and secondary half sections (110*a*, 120*a*) of the plurality of integrally formed primary and secondary horn parts (110, 120). Installation thereof may be conducted at a number equal to or fewer than that of the primary and secondary halves (110*a*, 120*a*) of the primary and secondary horn parts (110, 120) without limitation. Also, primary case (52) and secondary case (54) of the enclosure (58) can be made of any commonly used speaker materials such as wood, metal, synthetic resin and paper.

In the embodiment mentioned above, the enclosure (58) has been explained by constituting each primary case (52) and secondary case (54) as separate components; however, the present disclosure is not limited to this. The fact that primary case (52) and secondary case (54) can be formed as an integrated integral case should be understood by persons with ordinary skill in the art.

The horn speaker (50), according to other embodiments, can be configured in a similar matter to the embodiment described above, and primary and secondary cases (52, 54) can simultaneously form the discharge outlet (112) of primary half section (110*a*) of the horn part (110) at both the front and rear. Specifically, primary and secondary cases (52, 54) can emit the source sound and the sound by making the direction of the discharge outlet (112) face the front and rear through forming the primary and secondary horn parts (110, 120) at one end and the other end of each inner surface.

In other words, the primary half section (110*a*) and the secondary half section (120*b*) are formed in the primary case (52), and the secondary half section (120*a*) and the primary half section (110*b*) may be correspondingly formed in the secondary case (54).

More specifically, primary case (52) has the integrally formed primary half section (110*a*) of the horn part (110). Primary half section (110*a*) of the horn part (110) amplifies the sound through guttural sound reinforcement and is formed on one side of the inner surface of primary case (52). Herein, primary half section (110*a*) of the horn part (110) that is integrally formed on the inner surface of primary case (52) is formed together with a seating groove (111*a*) where the speaker unit (56*a*) can be seated. The seating groove (111*a*) has a structure for collecting the source sound generated from the speaker unit (56*a*) and is preferably formed to correspond to the shape and the size of the speaker unit (56*a*).

In addition, primary half section (110*a*) of the horn part (110) formed in primary case (52) extends beyond the partition wall (113*a*) on the opposite side of the seating groove (111*a*) and to the outer surface of the discharge outlet (112*a*) and is formed as its area is radially and gradually enlarged. Herein, the partition wall (113*a*) has a structure for performing a function of a guttural sound reinforcement to prevent the source sound collected in the seating groove (111*a*) from being dispersed and can be formed at an even higher height than that of the seating groove (111*a*).

In addition, primary case (52) has secondary half section (120*a*) of the horn part (120) formed close to the other side of primary half section (110*a*) of the horn part (110). Secondary half section (120*a*) of the horn part (120) has a seating location (121*a*), and secondary horn part (120) has a hook shape that extends from one side of primary case (52) to the other side of secondary case (54) toward the seating groove (111*a*) formed on primary half section (110*a*) of the horn part (110) of secondary case (54), which is mentioned later. Also, the end of the hook-shaped secondary half section (120*a*) of the horn part (120) has an integrally formed seating location (121*a*). It is preferable that the seating location (121*a*) be formed to correspond to the shape and the size of aforementioned seating groove (111*a*) and speaker unit (56*a*). More specifically, it is coupled with a curved surface by being matched with the shape of the integrally formed primary half section of the horn part (110) of secondary case (54), which is mentioned later, and the shape of a duct structure is formed when primary case (52) and secondary case (54) are coupled together. Also, a space for the speaker unit (56*a*) to be rested and installed is established on the upper part of the seating location (121*a*) formed at the end of secondary half section (120*a*) of the horn part (120). Furthermore, the seating location (121*a*) formed in primary case (52) has a flexibility quality and improves the loudness by preventing the source sound generated from the speaker unit (56*a*) from being leaked because it is attached with a high adhesion due to its flexible quality when primary case (52) and secondary case (54) are coupled together.

Secondary case (54), according to other embodiments of the present disclosure, can be comprised corresponding to the embodiment described above, and primary and secondary cases (52, 54) can simultaneously form the discharge outlet (112*a*) of primary half section (110*a*) of the horn part (110) at the front and rear. Specifically, primary and secondary cases (52, 54) can emit the source sound by making the direction of the discharge outlet (112*a*) face the front and rear through forming primary and secondary half sections (110*a*, 120*a*) of the horn parts (110, 120) at one end and the other end of each inner surface.

More specifically, secondary case (54) has integrally formed primary half section (110*a*) of the horn part (110). Primary half section (110*a*) of the horn part (110) amplifies the sound through guttural sound reinforcement and is formed on one side of the inner surface of secondary case (54). Herein, primary half section (110*a*) of the horn part (110) that is integrally formed on the inner surface of secondary case (54) is formed together with a seating groove (111*a*) where the speaker unit (56*a*) can be seated. The seating groove (111*a*) has a structure for collecting the source sound generated from the speaker unit (56*a*) and is preferably formed to correspond to the shape and the size of the speaker unit (56*a*).

Horn part (110) formed in secondary case (54) extends from the seating groove (111*a*) beyond the opposing partition wall (113*a*) to the outer surface of the discharge outlet (112*a*); the discharge outlet (112*a*) is formed in such a manner that the surface area is gradually enlarged radially on the surface. Herein, the partition wall (113*a*) is of a structure for performing a guttural sound reinforcement function so that sound sources collected in the seating groove (111*a*) are not dispersed, and it is formed higher than the height of the seating groove (111*a*).

In addition, secondary case (54) holds secondary half section (120*a*) of the horn part (120) formed close to the other side of the horn part (110). The secondary half section (120*a*) of horn part (120) has a hook shape that extends from one side of secondary case (54) towards the seating groove (111*a*) of primary case (52), being extended from one side to the other. Also, the end of the hook-shaped secondary half section (120*a*) of the horn part (120) has an integrally formed seating location (121*a*). It is preferable that the seating location (121*a*) be formed to correspond to the shape and the size of seating groove (111*a*) and speaker unit (56*a*) that are formed in the primary case (52). More specifically, it is coupled with a curved surface by being matched with the shape of the integrally formed primary half section (110*a*) of the horn part (110) of aforementioned primary case (52), and the shape of a duct structure is formed when primary case (52) and secondary case (54) are coupled together. Also, a space for the speaker unit (56*a*) to be rested and installed is established on the upper part of the seating location (121*a*) formed at the end of secondary half section (120*a*) of the horn part (120). Furthermore, the seating location (121*a*) formed in secondary case (54) has a flexible quality and improves the loudness by preventing the source sound generated from the speaker unit (56*a*) from being leaked because it is attached with a high adhesion due to its flexible quality when primary case (52) and secondary case (54) are coupled together.

To explain the coupling method of the enclosure (58) according to other embodiments of the present disclosure mentioned above, case fasteners (400*a*) are formed around the edges of the inner surfaces at diagonally opposite corners of primary case (52) and secondary case (54) and, when primary case (52) and secondary case (54) are mutually coupled, they are coupled by the case fastening members (400). At this time, each of integrally formed primary and secondary half sections (110*a*, 120*a*; 110*b*, 120*b*) of the horn parts (110, 120) of primary and secondary cases (52, 54) is comprised in a duct structure, and this can extend the reproduction band of sound by favorably collecting the sound source being discharged to the front and the rear of the speaker units (56*a*, 56*b*). Since the amplitude of the resonance point in the same band is decreased, the distortion of the sound is reduced.

More specifically, when primary and secondary cases (52, 54) are coupled together, the seating location (121*a*) integrally formed on the inner surface of primary case (52) is installed corresponding to the seating groove (111*a*) integrally formed on the inner surface of secondary case (54), which is formed on one side. In addition, the seating location (121*b*) integrally formed on the inner surface of secondary case (54) is installed corresponding to the seating groove (111*b*) integrally formed on the inner surface of primary case (52), which is formed on the other side. Furthermore, each primary and secondary half sections (110*a*, 120*a*; 110*b*, 120*b*) of the primary and secondary horn parts (110, 120) formed in primary and secondary cases (52, 54) has a discharge outlet (112*a*, 112*b*) on the other side of each other.

Then, the speaker unit (56*a*) is installed in an established space at the upper part of the seating location (121*a*) of primary case (52) and secondary case (54). Unit fasteners (500*a*) are formed around the seating groove (111*a*) and seating location (121*a*) of primary and secondary cases (52, 54). In order to prevent the source sound from being leaked from the upper part of the seating location (121*a*) of primary and secondary cases (52, 54), a separate sealing member (300) is initially seated at the upper part of the seating location (121*a*) when the speaker unit (56*a*) is coupled with the unit fastening members (500). Herein, the sealing member (300) is used for maintaining the airtightness, similar to a gasket, and is a typical component part; therefore, the detailed description thereof is omitted.

Hereby, the speaker unit (56*a*) seated on each seating location (121*a*, 121*b*) of primary and secondary cases (52, 54) is installed by being seated on the upper part of each seating location (121*a*, 121*b*) of primary and secondary cases (52, 54). Herein, the number of speaker units (56) can be installed corresponding to the number of discharge outlets (112) of integrally formed primary and secondary half sections of the horn parts (110, 120) and can be installed, without limitation, at an amount equal to or fewer than that of the primary and secondary horn parts (110, 120). Moreover, primary and secondary cases (52, 54) can be made of any commonly used speaker materials such as wood, metal, synthetic resin and paper.

Therefore, as depicted in FIGS. 3 and 4, horn speaker (50) is formed with the front surface of primary case (52), that is, with a plurality of discharge outlets (112*a*, 112*b*) in the forward side; the corresponding speaker units (56*a*, 56*b*) are connected by a curved duct structure that is not directly rearward as a structure that is disposed in an intersecting manner, so that not only is it possible to reduce the overall thickness of the enclosure (58), but the collected sound waves are guided by the duct shape and moved toward the discharge ports (112*a*, 112*b*), expanded (increased) and discharged, so that while having a compact structure compared to the conventional art, the separation and clarity of the sound collected and discharged sound can be considerably improved.

As such, the ambience and sound quality can be improved by minimizing the transmission of sound diffusion and noise, while maximizing the sound transmission effect when the source sound generated by the speaker unit is discharged through the discharge outlet of the horn by integrally forming the horn in primary case and secondary case of the enclosure. Moreover, the separation and clarity of sound is improved through having discharge outlets of a plurality of horns to be formed to face one side and the other side.

In addition, the structure thereof has been simplified and the product size has been reduced, so that the inconvenience of assembling parts and the cost of production are reduced. Furthermore, the reproduction band of sound can be extended by forming a horn in a duct structure and adding sound pressure by combining it with the sound discharged from the resonance of the duct in a forward direction and a backward direction. Since the amplitude of the resonance point is reduced in the same band, sound distortion can be reduced.

The dimensions of the enclosure (58) provide a compact packaging profile for the horn speaker (50). The minimized thickness dimension of the enclosure (58) makes possible its installation in the confined volumetric space at the front end of a ground transportation vehicle. This is especially true for newly designed motor vehicles, in which the clearance between the radiator assembly and the front grille/bumper has been reduced as compared to that of legacy motor vehicles.

FIGS. 10A and 10B are, respectively, frontal and side elevation views showing the dimensions of a preferred enclosure (58) of the horn speaker (50). FIG. 10A shows that enclosure (58) measures 5.5 in. (approximately 14 cm) in each of length and width, and FIG. 10B shows that enclosure (58) measures 1.5 in. (approximately 3.8 cm) in thickness. In contrast, a conventional horn siren package typically measures 6.25 in. (approximately 15.9 cm) in each of length and width and 3.15 in. (approximately 8 cm) in thickness.

FIG. 11 is a simplified diagram showing a top plan view of a conventional horn speaker (600) installed in a space between an inside surface (602) of a front end grille (604) and a front surface (604) of a radiator assembly (608) installed inside the motor compartment of a legacy motor vehicle. FIG. 11 shows that a distance (610) of at least 3.15 in. (approximately 8 cm) is needed between grille surface (602) and radiator assembly surface (606) to accommodate the thickness of the installed horn speaker (600).

FIG. 12 is a simplified diagram showing a top plan view of the horn speaker (50) installed in a space between an inside surface (702) of a front end grille (704) and the front surface (606) of the radiator assembly (608) installed inside the motor compartment of a newly designed motor vehicle. FIG. 12 shows that a distance (710) between grille surface (702) and radiator assembly surface (606) is reduced to 1.5 in. (3.8 cm) into which enclosure (58) of the installed horn speaker (50) must fit. Dashed lines (712), which are superimposed around the installed horn speaker (50), represent the clearance required by the thickness dimension (610) of the prior art horn speaker (600) and show that it would not fit in such newly designed vehicles.

Thus, the disclosed horn speaker (50) is capable of forming enclosure (58) with a minimized thickness dimension, resulting in a compact packaging profile to be installed within a defined volume space.

The above description is illustrative of the disclosed horn speaker. Since embodiments described in the specification are not meant to limit the technical idea of the present invention, but rather for the purposes of illustration, it should be possible for person with ordinary skill in the art to which the invention pertains to make various changes and modifications without deviating from the scope of technical ideas of the present invention. Therefore, the scope of protection for the present invention is interpreted by the matters described in the claims, and it should also be interpreted for technical matters within the same scope to be included in the scope of rights of the present invention.

The invention claimed is:

1. A horn speaker, comprising:

a speaker unit that generates a sound wave by converting an electric signal into a sound wave signal;

an enclosure including a primary case and a secondary case for housing the speaker unit the primary case having a primary inner section, and the secondary case having a secondary inner section;

a seating groove and a discharge outlet formed on the primary inner section of the primary case, the seating groove separated from the discharge outlet by a partition wall, and the discharge outlet in sonic communication with the secondary inner section; and a seating portion on which the speaker unit is seated to guide sound waves generated from the speaker unit for collection into the seating groove, the seating portion formed in the secondary inner section of the secondary case, the partition wall formed to guide the collected sound waves through the secondary inner section and into the discharge outlet and the discharge outlet formed to expand the collected sound waves and discharge them outside of the enclosure.

2. The horn speaker of claim 1, wherein the primary inner section is one from among a plurality of inner sections of the primary case, and the secondary inner section is one from among a plurality of inner sections of the secondary case.

3. The horn speaker of claim 2, wherein the speaker unit is one from among a plurality of speaker units, and wherein the number of a plurality of secondary inner sections of the secondary case corresponds to the number of speaker units seated in the secondary case.

4. The horn speaker of claim 1, wherein the primary inner section is a first primary inner section and the primary case further includes a second primary inner section; and wherein the secondary inner section is a first secondary inner section and the secondary case further includes a second secondary inner section.

5. The horn speaker of claim 4, wherein the speaker unit is a primary speaker unit, and the seating portion is a primary seating portion; and further comprising a secondary speaker unit seated on a secondary seating portion formed in the second secondary inner section.

6. The horn speaker of claim 4, wherein the first and second secondary inner sections receive sound waves generated by the primary and secondary speaker units.

7. The horn speaker of claim 1, wherein the primary case and the secondary case are coupled so that the primary and secondary inner sections have the structure of an integral duct shape.

8. A method of configuring a horn speaker enclosure for installation in a confined volumetric space between a front grille and components contained in a motor compartment of a ground transportation vehicle, comprising:

providing an enclosure formed of primary and secondary cases having outer surfaces separated by a distance, that defines the thickness dimension of the enclosure;

the primary case including a primary inner section, and the secondary case including a secondary inner section spatially aligned with the primary inner section;

the primary inner section including a partition wall that separates a seating groove and to discharge outlet, and the secondary inner section seating in a seating portion a speaker unit that generates and emits in an initial discharge direction sound waves for collection into the seating groove of the spatially aligned primary inner section;

the partition wall formed to guide the collected, sound waves through the secondary inner section to the discharge outlet of the spatially aligned primary inner section, the collected sound waves propagating in a direction transverse to the initial discharge direction and away from the speaker unit, and subsequently transmitted along a curved path towards the discharge outlet, the discharge outlet expanding the collected sound waves for discharge out of the enclosure from the speaker unit; and the sound wave transmission in the primary and secondary inner sections enabling production of loud sound source signal emissions from the enclosure having a minimized thickness direction, as well as a compact packaging profile, accommodating installation the confined volumetric space.

9. The method of claim 8, in which:

the primary inner section includes separate first and second primary half sections, the secondary inner section includes first and second secondary half sections spatially aligned with the respective first and second primary half sections, the partition wall is a first partition wall, the seating groove is a first seating groove, the discharge outlet is a first discharge outlet, the initial discharge direction is a first initial discharge direction, and the sound waves for collection are first sound waves for collection that are included in the first primary half section, and the seating portion is a first seating portion and the speaker unit is a first speaker unit that are included in the first secondary half section;

and further comprising, in the second primary half section, a second partition wall that separates a second seating groove and a second discharge outlet, and, in the second secondary half section, seating in a second seating portion a second speaker unit that generates and emits in a second initial discharge direction second sound waves for collection into the second seating groove of the spatially aligned second primary half section, and the second partition wall formed to guide the second collected sound waves through the second secondary half section to the second discharge outlet of the spatially aligned second primary half section, the second collected sound waves propagating in a direction transverse to the second initial discharge direction and away from the second speaker unit, and subsequently transmitted along a second curved, path toward the second discharge outlet, the second discharge outlet expanding the collected sound waves for discharge out of the enclosure from the second speaker unit.

10. The method of claim 9, wherein each discharge outlet discharges the collected sound waves from the same one of the outer surfaces of the enclosure.

11. The method of claim 9, wherein each discharge outlet discharges the collected sound waves from one of first and second outer surfaces of the enclosure, and wherein each speaker unit seated in a seating portion is accessible for installation in and removal from the other one of the first and second outer surfaces of the enclosure.

* * * * *